US012275577B2

(12) United States Patent
Joseph

(10) Patent No.: US 12,275,577 B2
(45) Date of Patent: Apr. 15, 2025

(54) WIG STORAGE ASSEMBLY

(71) Applicant: Kim Joseph, Stamford, CT (US)

(72) Inventor: Kim Joseph, Stamford, CT (US)

( * ) Notice: Subject to any disclaimer, the term of this patent is extended or adjusted under 35 U.S.C. 154(b) by 9 days.

(21) Appl. No.: 18/231,321

(22) Filed: Aug. 8, 2023

(65) Prior Publication Data

US 2025/0051089 A1 Feb. 13, 2025

(51) Int. Cl.
*B65D 85/18* (2006.01)
*B65D 21/02* (2006.01)

(52) U.S. Cl.
CPC ..... *B65D 85/18* (2013.01); *B65D 21/0201* (2013.01); *B65D 2205/02* (2013.01); *B65D 2543/00018* (2013.01)

(58) Field of Classification Search
CPC ..... B65D 85/18; B65D 21/0201; B65D 2205/02; B65D 2543/00018; B65D 5/4295; B65D 21/0209
USPC ..... 206/278, 8; 223/66, 24, 84; 220/23.87
See application file for complete search history.

(56) References Cited

U.S. PATENT DOCUMENTS 466,626 A * 1/1892 Sanders ..... A47B 49/004 206/8
633,864 A * 9/1899 Lindsey ..... A47B 53/02 312/247
1,109,722 A * 9/1914 Weiss ..... A45C 11/02 206/8
1,520,932 A * 12/1924 Comstock ..... A45C 11/02 206/8
1,729,953 A * 10/1929 Luery ..... A45C 11/02 206/8
3,506,112 A * 4/1970 Feinberg ..... A45C 11/00 312/351
3,621,988 A * 11/1971 Songer ..... A45C 11/00 206/757
3,628,655 A * 12/1971 Bohannon ..... A45C 11/00 206/8
3,728,003 A * 4/1973 Bohannon ..... A47F 7/065 312/285
3,770,114 A * 11/1973 Jackson ..... A45C 11/00 220/4.27
3,891,082 A * 6/1975 Fall ..... B65D 85/18 206/8
4,069,853 A 6/1978 Surabian
4,616,747 A * 10/1986 Zimmerman ..... A45D 4/02 248/176.1

(Continued)

FOREIGN PATENT DOCUMENTS

WO WO9915418 4/1999

*Primary Examiner* — Steven A. Reynolds
*Assistant Examiner* — Prince Pal

(57) ABSTRACT

A wig storage assembly includes a plurality of boxes that is each structured to define an interior storage area to contain a wig. The plurality of boxes is stackable on top of each other having each of the plurality of boxes being removably attached together to facilitate a plurality of the wigs to be simultaneously transported. A plurality of screens is each releasably attachable to a respective one of the plurality of boxes to retain the wig in the interior storage area of the respective box. A plurality of dividers is each insertable into the interior storage area defined in a respective one of the plurality of boxes for dividing the interior storage area of the respective box. A lid is removably attachable to a topmost one of the plurality of boxes when the plurality of boxes is stacked for carrying the stack of plurality of boxes.

9 Claims, 7 Drawing Sheets

(56) References Cited

U.S. PATENT DOCUMENTS 4,655,360 A * 4/1987 Juhanson ..... B65D 1/243 220/519
5,426,885 A * 6/1995 Wittman ..... A45C 13/02 312/319.1
5,547,098 A * 8/1996 Jordan ..... B25H 3/06 220/528
5,573,114 A * 11/1996 Cyr ..... A45C 11/38 220/531
8,172,080 B1 * 5/2012 Schantz ..... B65D 85/18 206/781
8,596,452 B1 * 12/2013 Banks ..... A45C 5/08 206/278
8,800,827 B2 * 8/2014 Choi ..... B65D 85/18 223/66
8,863,546 B2 * 10/2014 Oberweis ..... F25D 3/14 62/441
8,960,469 B1 * 2/2015 Helal ..... B65B 5/04 206/508
D759,370 S * 6/2016 Godzich ..... D3/216
2005/0109643 A1 * 5/2005 Huang ..... A61L 2/202 206/278
2005/0155889 A1 * 7/2005 Lown ..... A01K 97/06 206/501
2006/0027586 A1 * 2/2006 Longhany ..... B65D 5/4295 220/676
2006/0096821 A1 * 5/2006 McKaba ..... A47B 43/003 206/278
2006/0108193 A1 * 5/2006 Lee ..... A45C 11/00 190/102
2007/0267311 A1 * 11/2007 Watkins ..... B42F 17/10 206/425
2010/0219193 A1 * 9/2010 Becklin ..... B65D 21/0224 220/630
2012/0006696 A1 * 1/2012 Choi ..... A45C 11/00 223/66
2012/0145718 A1 * 6/2012 Quarry ..... A45C 11/20 220/507
2013/0075288 A1 * 3/2013 Bielski ..... D06F 95/006 53/473
2013/0126373 A1 * 5/2013 Wadsworth ..... B65B 5/10 53/471
2015/0173531 A1 * 6/2015 Rosenblatt ..... A45C 13/02 206/8
2020/0062493 A1 * 2/2020 Joseph ..... A45C 3/001

* cited by examiner

WIG STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to storage devices and more particularly pertains to a new storage device for storing and transporting a plurality of wigs. The device includes a plurality of boxes that are attachable together to form a vertical stack for carrying a plurality of wigs. The device includes a plurality of screens that are each attachable to a respective box for closing the respective box and retaining the wig in the respective box. A plurality of dividers is included which can each be positioned inside a respective box for dividing an interior of the respective box to store a plurality of wigs. The device includes a lid that is attachable to a topmost one of the vertical stack of boxes and a handle is attached to the lid for carrying the vertical stack of boxes.

(2) Description of Related Art Including Information Disclosed Under 37 CFR 1.97 and 1.98

The prior art relates to storage devices including a variety of wig storage boxes that are each uniquely structured to store a wig. In no instance does the prior art discloses a wig storage device that includes a plurality of boxes that are releasably attachable together in a vertical stack for containing and transporting a plurality of wigs.

BRIEF SUMMARY OF THE INVENTION

An embodiment of the disclosure meets the needs presented above by generally comprising a plurality of boxes that is each structured to define an interior storage area to contain a wig. The plurality of boxes is stackable on top of each other having each of the plurality of boxes being removably attached together to facilitate a plurality of the wigs to be simultaneously transported. A plurality of screens is each releasably attachable to a respective one of the plurality of boxes to retain the wig in the interior storage area of the respective box. A plurality of dividers is each insertable into the interior storage area defined in a respective one of the plurality of boxes for dividing the interior storage area of the respective box. A lid is removably attachable to a topmost one of the plurality of boxes when the plurality of boxes is stacked for carrying the stack of plurality of boxes.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
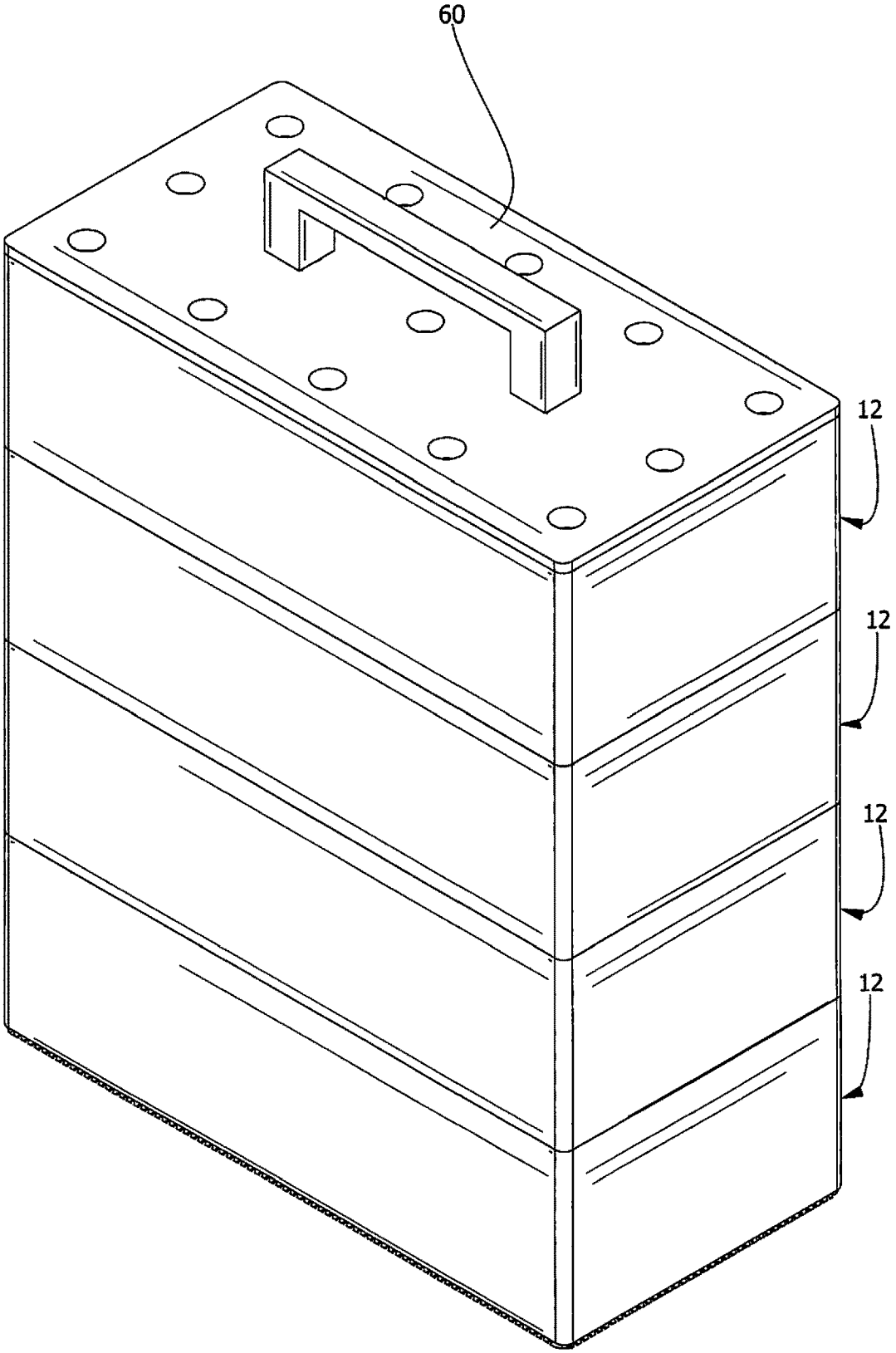
FIG. 1 is a perspective view of an embodiment of the disclosure.
Figure 2:
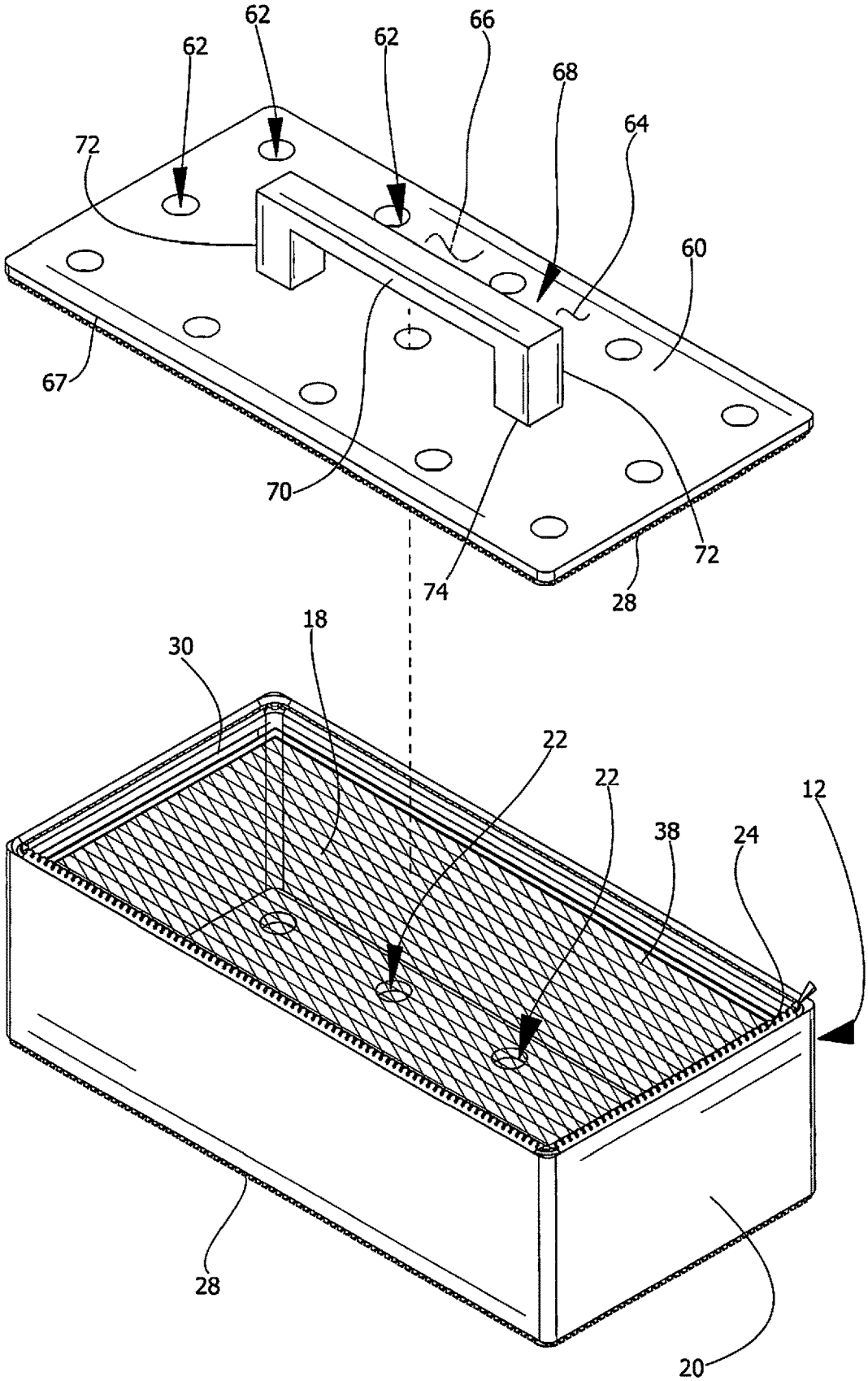
FIG. 2 is an exploded perspective view of an embodiment of the disclosure showing a lid and a box.
Figure 3:
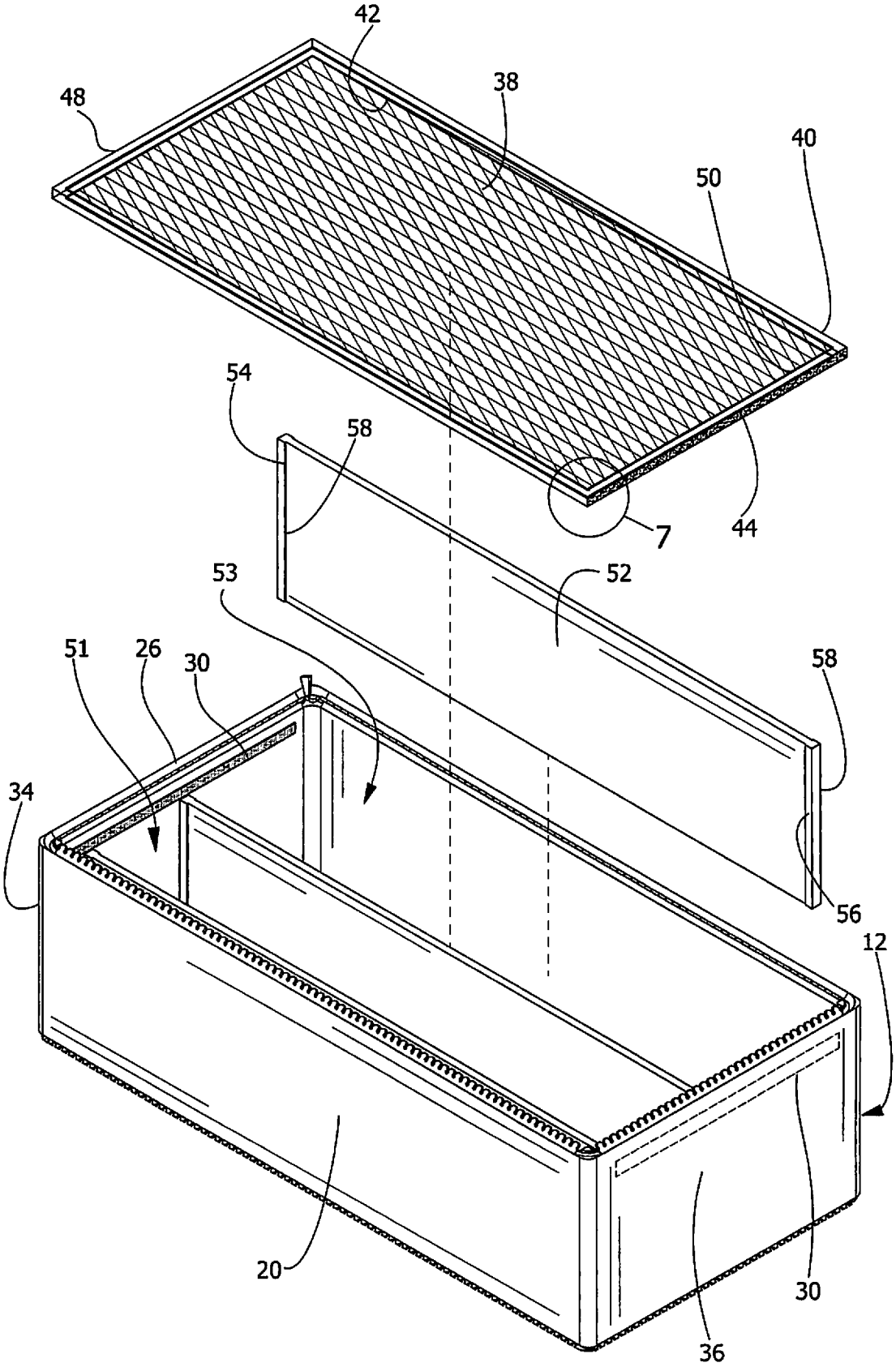
FIG. 3 is an exploded perspective view of an embodiment of the disclosure showing a screen and divider and a box.
Figure 4:
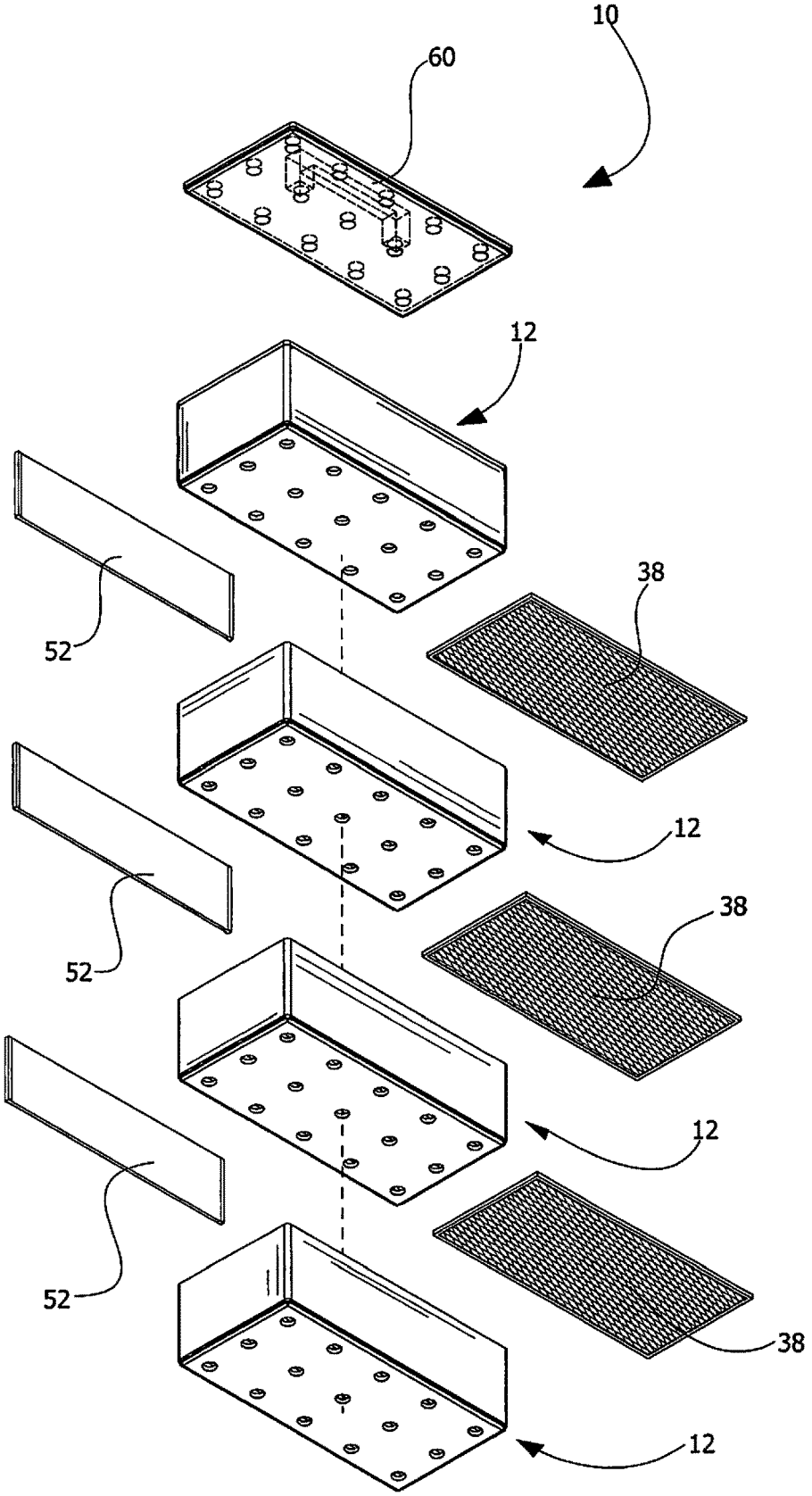
FIG. 4 is an exploded view of a wig storage assembly according to an embodiment of the disclosure.
Figure 5:
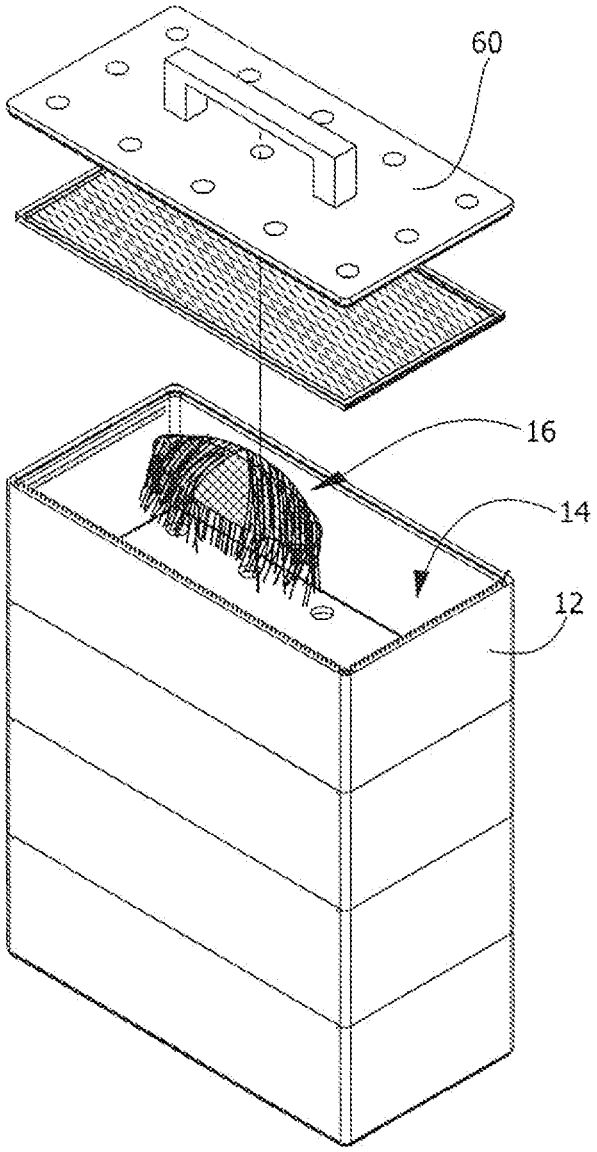
FIG. 5 is a perspective in-use view of an embodiment of the disclosure.

With reference now to the drawings, and in particular to FIGS. 1 through 7 thereof, a new storage device embodying the principles and concepts of an embodiment of the disclosure and generally designated by the reference numeral 10 will be described.

As best illustrated in FIGS. 1 through 7, the wig storage assembly 10 generally comprises a plurality of boxes 12 that is each structured to define an interior storage area 14 associated with each of the plurality of boxes 12 for containing a wig 16. The wig 16 may be a wig of synthetic hair, a wig of natural hair or any other type of wig that might be worn for costuming purposes or for beauty enhancement purposes. Each of the plurality of boxes 12 is stackable on top of each other having each of the plurality of boxes 12 being removably attached together. In this way the plurality of boxes 12 facilitates a plurality of the wigs 16 to be simultaneously transported.

Each of the boxes 12 has a bottom wall 18 and a perimeter wall 20 extending upwardly from the bottom wall 18 and the bottom wall 18 of each of the plurality of boxes 12 has a plurality of air holes 22 each extending through the bottom wall 18. Each of the plurality of air holes 22 ventilates the interior storage area 14 for inhibiting the wigs 16 from becoming moistened with humidity. A plurality of first couplers 24 is each attached to the perimeter wall 20 of a respective one of the plurality of boxes 12 and each of the first couplers 24 extends along a full length of a distal edge 26 of the perimeter wall 20 associated with the respective box 12. A plurality of second couplers 28 is each attached to the bottom wall 18 of a respective one of the plurality of boxes 12 and each of the second couplers 28 extends along a full length of an intersection between the bottom wall 18 and the perimeter wall 20 of the respective box 12. Furthermore, each of the plurality of second couplers 28 is releasably matable to a respective one of the plurality of first couplers 24 when the boxes 12 are stacked for releasably attaching the plurality of boxes 12 that are stacked to each other. Each of the plurality of first couplers 24 and each of the plurality of second couplers 28 may comprise a zipper or other type of releasable mechanical coupler.

A plurality of first mating members 30 is each attached to an interior surface 32 of the perimeter wall 20 of a respective one of the plurality of boxes 12. Each of the plurality of first mating members 30 is positioned on a respective one of a first lateral side 34 and a second lateral side 36 of the perimeter wall 20 associated with the respective box 12. Additionally, each of the first mating members 30 is spaced from the distal edge 26 of the perimeter wall 20 of the respective box 12. Each of the first mating members 30 may comprise a hook and loop fastener or other type of multiple use, releasable fastener.

A plurality of screens 38 is each releasably attachable to a respective one of the plurality of boxes 12 for closing the interior storage area 14 defined in the respective box 12. In this way each of the plurality of screens 38 retain the wig 16 in the interior storage area 14 of the respective box 12. Each of the plurality of screens 38 has a border 40 extending around a perimeter edge 42 of the screen 38 and the border 40 associated with each of the plurality of screens 38 is comprised of a rigid material for retaining each of the plurality of screens 38 in a planar orientation. Additionally, each of the plurality of screens 38 comprises a mesh screen to facilitate air to pass through each of the plurality of screens 38.

A plurality of second mating members 44 is provided and each of the plurality of second mating members 44 is attached to an outwardly facing surface 46 of a respective one of a first lateral side 48 and a second lateral side 50 of the border 40 associated with a respective one of the plurality of screens 38. Each of the plurality of second mating members 44 on the border 40 associated with a respective one of the plurality of screens 38 releasably engages a respective one of the plurality of first mating members 30 associated with a respective one of the plurality of boxes 12 for attaching the respective screen 38 to the respective box 12. Each of the second mating members 44 may comprise a hook and loop fastener or other type of multiple use, releasable fastener.

A plurality of dividers 52 is each insertable into the interior storage area 14 defined in a respective one of the plurality of boxes 12 for dividing the interior storage area 14 of the respective box 12 into a first portion 51 and a second portion 53 of the interior storage area 14 of the respective box 12. In this way a plurality of wigs 16 each of the plurality of dividers 52 has a first end 54 and a second end 56. Each of the plurality of dividers 52 has a pair of grips 58 that is each disposed on a respective one of the first end 54 and the second end 56. Each of the pair of grips 58 associated with each of the plurality of dividers 52 abuts the interior surface 32 of associated with a respective one of the first lateral side 34 and the second lateral side 36 of the perimeter wall 20 associated with the respective box 12 when a respective divider 52 is positioned in the respective box 12. Each of the pair of grips 58 associated with each of the plurality of dividers 52 is comprised of a friction enhancing material to facilitate each of the pair of grips 58 associated with each of the plurality of dividers 52 to frictionally engage the interior surface 32 of the respective first lateral side 34 and the second lateral side 36 of the perimeter wall 20 associated with the respective box 12.

A lid 60 is removably attachable to a topmost one of the plurality of boxes 61 when the plurality of boxes 12 is stacked for carrying the stack of plurality of boxes 12. The lid 60 has a plurality of air holes 62 each extending through an upper surface 64 and a lower surface 66 of the lid 60 to pass air through the lid 60. A respective one of the plurality of second couplers 28 is attached to the lower surface 66 of the lid 60 and the second coupler 28 associated with the lid 60 is aligned with and extends around a full length of a perimeter edge 67 of the lid 60. The second coupler 28 associated with the lid 60 is releasably matable to the first coupler 28 associated with a respective one of the plurality of boxes 12 for attaching the lid 60 to the respective box 12.

A handle 68 is provided which has a central member 70 extending between a pair of outward members 72. Each of the outward members 72 has a lower end 74 that is attached to the upper surface 64 of the lid 60 such that the central member 70 is spaced from the upper surface 64 of the lid 60. In this way the central member 70 can be gripped for carrying the lid 60 and the respective box 12 to which the lid 60 is attached. The handle 68 is centrally positioned on the lid 60 and a respective one of the plurality of air holes 62 associated with the lid 60 is centrally positioned between the pair of outward members 72 such that the respective air hole 62 associated with the lid 60 is positioned beneath the central member 70.

Figure 6:
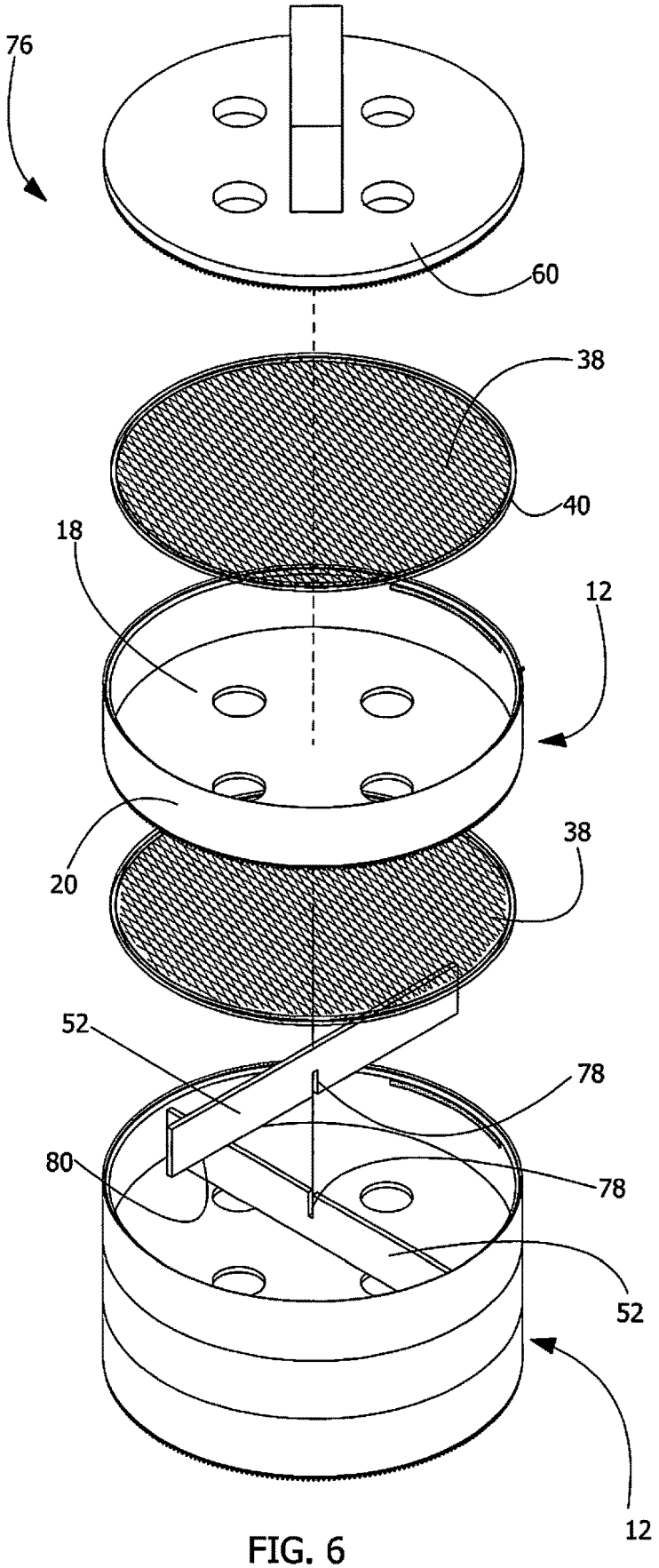
FIG. 6 is an exploded perspective view of an alternative embodiment of the disclosure.
Figure 7:
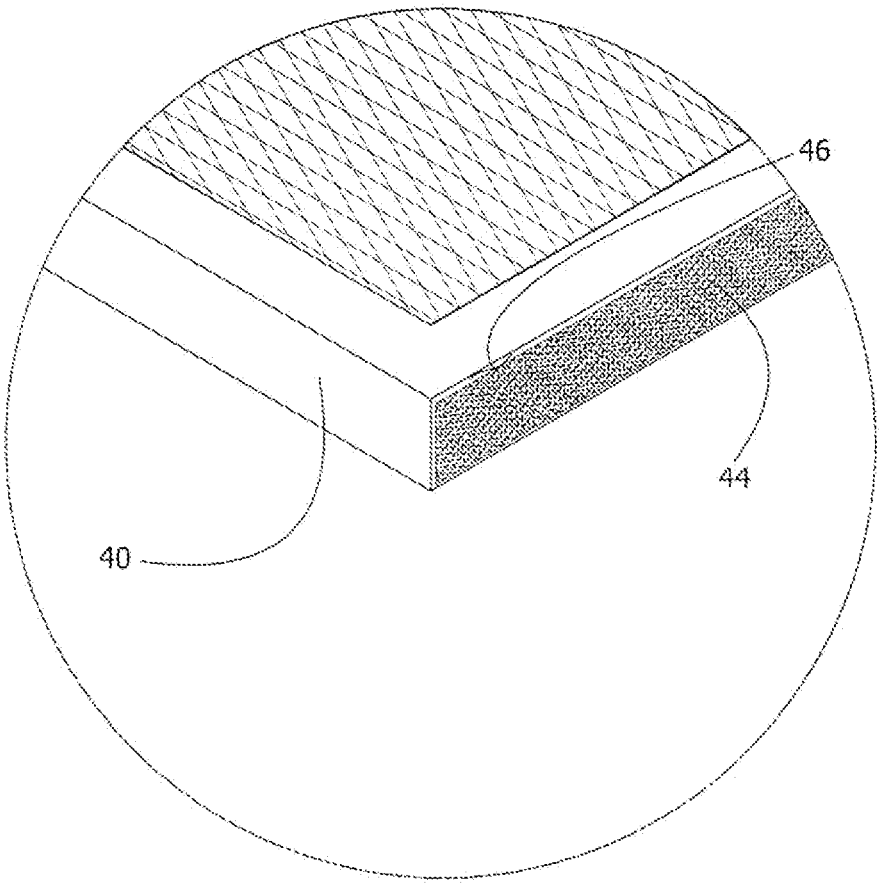
FIG. 7 is a magnified detail vie taken from circle 7 of FIG. 3 of an embodiment of the disclosure.

In an alternative embodiment 76 as shown in FIG. 6, the perimeter wall 20 associated with each of the plurality of boxes 12 is continuously arcuate about a center of the bottom wall 18 such that each of the plurality of boxes 12 has a circular shape. The border 40 associated with each of the plurality of screens 38 is continuously arcuate about a center of a respective screen 38 such that each of the plurality of screens 38 has a circular shape. Continuing in the alternative embodiment 76, each of the plurality of dividers 52 has a slot 78 extending upwardly in a first edge 80 of the dividers 52. The slot 78 in a respective one of the plurality of dividers 52 engages the slot 78 in a respective one of the plurality of dividers 52 such that the pair of respective dividers 52 forms an X-shape.

In use, each of a plurality of wigs 16 can be stored in the interior storage area 14 of a respective one of the boxes 12 and each of the screens 38 is attached to a respective box 12. The respective boxes 12 can be stacked and attached together and the air holes 22 in the bottom wall 18 of each of the boxes 12 and the plurality screens 38 facilitate air to move through the stacked boxes 12. In this way the plurality of wigs 16 are kept at the same temperature and humidity as ambient air to enhance storing the plurality of wigs 16. The lid 60 can be attached to the topmost box 61 and the handle 68 can be gripped for transporting the stacked boxes 12. Additionally, the dividers 52 can be positioned in the boxes 12 to facilitate a plurality of wigs 16 in each box 12 to be kept separate from each other.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wig storage assembly for storing a plurality of wigs in an environmentally favorable environment, said assembly comprising:

a plurality of boxes each being structured to define an interior storage area associated with each of said plurality of boxes wherein said interior storage area of each of said plurality of boxes is configured to contain a wig, each of said plurality of boxes being stackable on top of each other having each of said plurality of boxes being removably attached together wherein said plurality of boxes is configured to facilitate a plurality of the wigs to be simultaneously transported;

a plurality of screens, each of said plurality of screens being releasably attachable to a respective one of said plurality of boxes for closing said interior storage area defined in said respective box wherein each of said plurality of screens is configured to retain the wig in said interior storage area of said respective box;

a plurality of dividers, each of said plurality of dividers being insertable into said interior storage area defined in a respective one of said plurality of boxes for dividing said interior storage area of said respective box into a first portion and a second portion of said interior storage area of said respective box;

a lid being removably attachable to a topmost one of said plurality of boxes when said plurality of boxes is stacked for carrying said stack of plurality of boxes;

wherein each of said boxes has a bottom wall and a perimeter wall extending upwardly from said bottom wall, said bottom wall of each of said plurality of boxes having a plurality of air holes each extending through said bottom wall wherein each of said plurality of air holes is configured to ventilate said interior storage area for inhibiting the wigs from becoming moistened with humidity;

wherein said assembly includes a plurality of first couplers, each of said first couplers being attached to said perimeter wall of a respective one of said plurality of boxes, each of said first couplers extending along a full length of a distal edge of said perimeter wall associated with said respective box;

wherein said assembly includes a plurality of second couplers, each of said second couplers being attached to said bottom wall of a respective one of said plurality of boxes, each of said second couplers extending along a full length of an intersection between said bottom wall and said perimeter wall of said respective box; and wherein each of said plurality of second couplers is releasably matable to a respective one of said plurality of first couplers when said boxes are stacked for releasably attaching said plurality of boxes that are stacked to each other.

2. The assembly according to claim 1, further comprising a plurality of first mating members, each of said first mating members being attached to an interior surface of said perimeter wall of a respective one of said plurality of boxes, each of said plurality of first mating members being positioned on a respective one of a first lateral side and a second lateral side of said perimeter wall associated with said respective box, each of said first mating members being spaced from said distal edge of said perimeter wall of said respective box.

3. The assembly according to claim 2, wherein:

each of said plurality of screens has a border extending around a perimeter edge of said screen, said border associated with each of said plurality of screens being comprised of a rigid material for retaining each of said plurality of screens in a planar orientation;

said assembly includes a plurality of second mating members, each of said plurality of second mating members being attached to an outwardly facing surface of a respective one of a first lateral side and a second lateral side of said border associated with a respective one of said plurality of screens; and each of said plurality of second mating members on said border associated with a respective one of said plurality of screens releasably engaging a respective one of said plurality of first mating members associated with a respective one of said plurality of boxes for attaching said respective screen to said respective box.

4. The assembly according to claim 1, wherein:

each of said plurality of dividers has a first end and a second end, each of said plurality of dividers having a pair of grips each being disposed on a respective one of said first end and said second end, each of said pair of grips associated with each of said plurality of dividers abutting said interior surface of associated with a respective one of said first lateral side and said second lateral side of said perimeter wall associated with said respective box when a respective divider is positioned in said respective box; and each of said pair of grips associated with each of said plurality of dividers is comprised of a friction enhancing material to facilitate each of said pair of grips associated with each of said plurality of dividers to frictionally engage said interior surface of said respective first lateral side and said second lateral side of said perimeter wall associated with said respective box.

5. The assembly according to claim 1, wherein:

said lid has a plurality of air holes each extending through an upper surface and a lower surface of said lid wherein each of said plurality of air holes associated with said lid is configured to pass air through said lid; and a respective one of said plurality of second couplers is attached to said lower surface of said lid, said second coupler associated with said lid being aligned with and extending around a full length of a perimeter edge of said lid, said second coupler associated with said lid releasably matable to said first coupler associated with a respective one of said plurality of boxes for attaching said lid to said respective box.

6. The assembly according to claim 5, wherein:

said assembly includes a handle having a central member extending between a pair of outward members, each of said outward members having a lower end being attached to said upper surface of said lid such that said central member is spaced from said upper surface wherein said central member is configured to be gripped for carrying said lid and said respective box to which said lid is attached, said handle being centrally positioned on said lid; and a respective one of said plurality of air holes is centrally positioned between said pair of outward members such that said respective air hole associated with said lid is positioned beneath said central member.

7. A wig storage assembly for storing a plurality of wigs in an environmentally favorable environment, said assembly comprising:

a plurality of boxes each being structured to define an interior storage area associated with each of said plurality of boxes wherein said interior storage area of each of said plurality of boxes is configured to contain a wig, each of said plurality of boxes being stackable on top of each other having each of said plurality of boxes being removably attached together wherein said plurality of boxes is configured to facilitate a plurality of the wigs to be simultaneously transported, each of said boxes having a bottom wall and a perimeter wall extending upwardly from said bottom wall, said bottom wall of each of said plurality of boxes having a plurality of air holes each extending through said bottom wall wherein each of said plurality of air holes is configured to ventilate said interior storage area for inhibiting the wigs from becoming moistened with humidity;

a plurality of first couplers, each of said first couplers being attached to said perimeter wall of a respective one of said plurality of boxes, each of said first couplers extending along a full length of a distal edge of said perimeter wall associated with said respective box;

a plurality of second couplers, each of said second couplers being attached to said bottom wall of a respective one of said plurality of boxes, each of said second couplers extending along a full length of an intersection between said bottom wall and said perimeter wall of said respective box, each of said plurality of second couplers being releasably matable to a respective one of said plurality of first couplers when said boxes are stacked for releasably attaching said plurality of boxes that are stacked to each other;

a plurality of first mating members, each of said first mating members being attached to an interior surface of said perimeter wall of a respective one of said plurality of boxes, each of said plurality of first mating members being positioned on a respective one of a first lateral side and a second lateral side of said perimeter wall associated with said respective box, each of said first mating members being spaced from said distal edge of said perimeter wall of said respective box;

a plurality of screens, each of said plurality of screens being releasably attachable to a respective one of said plurality of boxes for closing said interior storage area defined in said respective box wherein each of said plurality of screens is configured to retain the wig in said interior storage area of said respective box, each of said plurality of screens having a border extending around a perimeter edge of said screen, said border associated with each of said plurality of screens being comprised of a rigid material for retaining each of said plurality of screens in a planar orientation;

a plurality of second mating members, each of said plurality of second mating members being attached to an outwardly facing surface of a respective one of a first lateral side and a second lateral side of said border associated with a respective one of said plurality of screens, each of said plurality of second mating members on said border associated with a respective one of said plurality of screens releasably engaging a respective one of said plurality of first mating members associated with a respective one of said plurality of boxes for attaching said respective screen to said respective box;

a plurality of dividers, each of said plurality of dividers being insertable into said interior storage area defined in a respective one of said plurality of boxes for dividing said interior storage area of said respective box into a first portion and a second portion of said interior storage area of said respective box, each of said plurality of dividers having a first end and a second end, each of said plurality of dividers having a pair of grips each being disposed on a respective one of said first end and said second end, each of said pair of grips associated with each of said plurality of dividers abutting said interior surface of associated with a respective one of said first lateral side and said second lateral side of said perimeter wall associated with said respective box when a respective divider is positioned in said respective box, each of said pair of grips associated with each of said plurality of dividers being comprised of a friction enhancing material to facilitate each of said pair of grips associated with each of said plurality of dividers to frictionally engage said interior surface of said respective first lateral side and said second lateral side of said perimeter wall associated with said respective box;

a lid being removably attachable to a topmost one of said plurality of boxes when said plurality of boxes is stacked for carrying said stack of plurality of boxes, said lid having a plurality of air holes each extending through an upper surface and a lower surface of said lid wherein each of said plurality of air holes associated with said lid is configured to pass air through said lid, a respective one of said plurality of second couplers being attached to said lower surface of said lid, said second coupler associated with said lid being aligned with and extending around a full length of a perimeter edge of said lid, said second coupler associated with said lid releasably matable to said first coupler associated with a respective one of said plurality of boxes for attaching said lid to said respective box; and a handle having a central member extending between a pair of outward members, each of said outward members having a lower end being attached to said upper surface of said lid such that said central member is spaced from said upper surface wherein said central member is configured to be gripped for carrying said lid and said respective box to which said lid is attached, said handle being centrally positioned on said lid, a respective one of said plurality of air holes being centrally positioned between said pair of outward members such that said respective air hole associated with said lid is positioned beneath said central member.

8. The assembly according to claim 7, wherein;

said perimeter wall associated with each of said plurality of boxes is continuously arcuate about a center of said bottom wall such that each of said plurality of boxes has a circular shape;

said border associated with each of said plurality of screens is continuously arcuate about a center of a respective screen such that each of said plurality of screens has a circular shape.

9. The assembly according to claim 7, wherein each of said plurality of dividers has a slot extending upwardly in a first edge of said dividers, said slot in a respective one of said plurality of dividers engaging said slot in a respective one of said plurality of dividers such that said pair of respective divider forms an X-shape.

* * * * *